US008220125B2

(12) United States Patent
Paulus et al.

(10) Patent No.: US 8,220,125 B2
(45) Date of Patent: Jul. 17, 2012

(54) ASSEMBLY AID AND METHOD FOR POSITIONING A HINGE IN A REPRODUCIBLE MANNER

(75) Inventors: Joerg Paulus, Burscheid (DE); Georg Dell, Remscheid (DE)

(73) Assignee: Edscha AG, Remscheid (DE)

( * ) Notice: Subject to any disclaimer, the term of this patent is extended or adjusted under 35 U.S.C. 154(b) by 1104 days.

(21) Appl. No.: 10/555,950

(22) PCT Filed: May 4, 2004

(86) PCT No.: PCT/DE2004/000938

§ 371 (c)(1),
(2), (4) Date: Dec. 4, 2006

(87) PCT Pub. No.: WO2004/101932

PCT Pub. Date: Nov. 25, 2004

(65) Prior Publication Data

US 2007/0107164 A1 May 17, 2007

(30) Foreign Application Priority Data

May 10, 2003 (DE) ..... 103 21 043

(51) Int. Cl.
*E05D 7/12* (2006.01)

(52) U.S. Cl. ..... 29/434; 29/466; 29/468; 16/254; 16/270; 16/387; 16/366

(58) Field of Classification Search ..... 29/434, 29/11, 464, 466, 468; 16/254, 270, 387, 16/366, 235, 247
See application file for complete search history.

(56) References Cited

U.S. PATENT DOCUMENTS 890,471 A * 6/1908 Taylor et al. ..... 16/270
(Continued)

FOREIGN PATENT DOCUMENTS

DE 34 02 809 8/1985
(Continued)

OTHER PUBLICATIONS

Machine translation of WO 01/40608 A1, Jun. 2001.*

*Primary Examiner* — David Bryant
*Assistant Examiner* — Christopher Besler
(74) *Attorney, Agent, or Firm* — Davidson, Davidson & Kappel, LLC

(57) ABSTRACT

The invention relates to an assembly aid for positioning a hinge (1) on a door arrangement part (12) in a reproducible manner, said assembly aid comprising a clamping screw (22) having a screw shank (23) and a screw head (21), and an adjusting element (20) which is applied to a part (17) of the hinge (1) in a positively locking manner. The adjusting element (20) radially engages with said screw shank (23) and can be axially fixed to the door arrangement part (12) by means of the clamping screw (22). The invention also relates to a method for the reproducible positioning of a hinge (1) on a door arrangement part (12) whereon a positioning axis (30) is provided. The aim of the invention is to provide an assembly aid and a method that enable a hinge to be precisely positioned in a simple and reproducible manner. To this end, the inventive assembly aid is embodied in such a way that there is radial play between the adjusting element (20) and the screw shank (23), and the screw head (21) engages with the adjusting element (20), or, according to the inventive method, an adjusting part (19) is arranged as a primary reference member at a distance from the positioning axis (30), and an adjusting element (20) is fixed in the position thereof as a secondary reference member with radial play in relation to the positioning axis (30).

41 Claims, 3 Drawing Sheets

U.S. PATENT DOCUMENTS

| | | | | | |
|---|---|---|---|---|---|
| 3,036,934 | A | * | 5/1962 | Horton et al. | 428/341 |
| 3,965,532 | A | * | 6/1976 | Wigfall | 16/270 |
| 4,120,760 | A | * | 10/1978 | Ueda | 205/86 |
| 5,398,379 | A | | 3/1995 | Kiefer | 16/364 |
| 5,570,498 | A | * | 11/1996 | Hipkiss et al. | 16/258 |
| 5,794,309 | A | | 8/1998 | Lotz | |
| 6,058,564 | A | | 5/2000 | Purcell et al. | 16/241 |
| 2003/0196297 | A1 | * | 10/2003 | Gerali et al. | 16/382 |

FOREIGN PATENT DOCUMENTS

| | | | |
|---|---|---|---|
| DE | 87 16 621 | U | 3/1988 |
| DE | 41 00 791 | | 9/1991 |
| DE | 200 08 292 | U | 10/2000 |
| EP | 0 756 055 | | 1/1997 |
| GB | 2 058 903 | | 4/1981 |
| GB | 2 199 888 | A | 7/1988 |
| JP | 62-268483 | | 11/1987 |
| JP | 63-176582 | | 7/1988 |
| JP | 9-221956 | | 8/1997 |
| JP | 10-299329 | | 11/1998 |
| JP | 10-315867 | | 12/1998 |
| WO | WO 0140608 | A1 * | 6/2001 |

* cited by examiner

ASSEMBLY AID AND METHOD FOR POSITIONING A HINGE IN A REPRODUCIBLE MANNER

The invention relates to a mounting aid according to the preamble of claim 1 and to a method according to the preamble of claim 15. The invention also relates to a hinge according to the preamble of claim 19 and to a method according to the preamble of claim 31.

It is known from practice to attach hinges to a door arrangement part, such as a door or door frame, in a desired adjusted position. To this end, part of the hinge is brought to bear against a bearing surface on the door arrangement part and moved until the desired adjusted position of the door has been found. When doors or hinges are mounted, it is in addition desired to be able to remove the door mounted in the adjusted position and to be able to install it again later in the same position without readjustment.

From practice, hinges are known which have fastening parts which have fastening areas resting on the bearing surface and on which fastening means are provided for fastening the hinge to the door arrangement part and in which the fastening areas point in different directions.

DE 87 16 621 U1 describes a mounting aid in which a screw is provided in an opening of a hinge part to be attached, it being possible for an adjusting element located in the opening to be secured by the screw head of this screw. The adjusting element fills the opening without play. The diameter of the screw head is less than the diameter of the adjusting element, the screw head only partly overlapping the adjusting element. Large holes must be provided on the door arrangement part, in which holes in each case the shank of the screw and the fastening screws have play required for the adjustment. During the adjustment, the screw moves with the hinge part, provided the play of the shank of the screw in the large hole allows it. If the desired adjusted position has been found, the screw is tightened, so that the screw head presses the adjusting element against the door arrangement part and fixes a reference position for the renewed mounting. During renewed mounting, the hinge part is placed over the door arrangement part normal to the bearing plane and put onto the bearing plane, the adjusting element on the door arrangement part fitting into the corresponding opening on the hinge part and the reference position thus being set without renewed adjustment. In a further step, the hinge part is pivoted about the reference member until the fastening screws engage in the associated holes. A disadvantage is that the shanks of the screw or of the fastening screws engage in holes with play. Thus neither the screw nor the fastening screws can be secured themselves in such holes without threads. To secure the hinge to the door arrangement part, additional means in which the screw shanks can engage must be provided, such as, for example, a threaded strip or nuts on that side of the door arrangement part which is remote from the hinge part. This means additional cost and a multiplicity of parts during the production of the door arrangement part and when securing the screws and the fastening screws. A further disadvantage is that only a single reference position in the form of the screw secured to the door arrangement part is provided. The hinge part remains at least partly pivotable about this screw. The hinge part is not secured in its position until the fastening screws are additionally fixed in their associated holes. The fastening screws likewise have play in these holes. A further disadvantage is that, to attach the door arrangement part again, the hinge part has to be placed over the door arrangement part and moved until a reference position specified by the adjusting element has been found. In this complicated step involving a search, it proves to be unfavorable that the hinge part partly covers the adjusting element attached to the door arrangement part until said adjusting element slips into the opening of the hinge part after a displacement of said opening. In addition, it proves to be disadvantageous that the screw is attached to the door arrangement part as a prominence, on which the hinge part, when being mounted again, can tilt or cant relative to the bearing plane when the hinge is moved toward the bearing plane normal to the latter.

DE 34 02 809 A1 specifies as mounting aid a system consisting of a positive and a negative guide area provided at the door arrangement part and the hinge part, respectively, the mutual oversize of these guide areas being compensated for by an auxiliary means, to be attached, as soon as the hinge part is in the desired adjusted position. Provided in the hinge part is an opening, within which a cylindrical pin is firmly arranged as positive guide area on the door arrangement part lying underneath. During the adjustment of the hinge part, the pin changes its position with respect to the opening in the hinge part. If the adjusted position of the hinge part has been found, the oversize is filled, for example by a bush being inserted with a handle. A disadvantage is that a large-sized opening having the proportions of the adjusting travel assumed is to be provided in the door arrangement part. A further disadvantage is that the provision of the pin inside the opening on the door arrangement part already constitutes considerable outlay. Especially in the found, adjusted position of the hinge part, in which said hinge part should no longer be moved but rather has to be secured immediately to the door arrangement part, a complicated, time-consuming action putting the adjusted position at risk is carried out with the insertion of the bush. Furthermore, it proves to be disadvantageous that only a single pin is fixed as reference, about which the hinge part is still at least partly pivotable during renewed mounting. Thus, when the hinge is mounted again, a readjustment to be carried out by hand is necessary, meaning that the method is unfavorable for automation. Furthermore, the pin secured in this way is designed to project from the bearing plane, it being necessary for the hinge part to be attached with the opening over the pin normal to the bearing plane when the hinge is being mounted again. There is thus the risk of the opening in the hinge part tilting or canting relative to the reference member when the hinge part is being mounted again.

EP 0 756 055 A1 describes as mounting aid a hole which passes through a hinge part and a door arrangement part and into which a screw bolt having a cylindrical longitudinal section is inserted. In the region of the hinge part, the hole has an oversize relative to the screw bolt, this oversize being filled by the insertion of auxiliary means, such as suitable flat material blanks or annular bodies. In this case, a guide area is obtained between the smooth-surface cylindrical longitudinal section of the shank part of the screw bolt and the inserted auxiliary means, e.g. the inner surface, facing the shank part, of the annular body. During the setting of the adjusted position, the hole having oversize relative to the screw bolt is displaced, the oversize being filled with the inserted auxiliary means in order to secure the adjusted position. The screw bolt has threaded sections at both ends, nuts having to be provided firstly on that side of the door arrangement part which is remote from the hinge part and secondly on the surface of the hinge part in order to be able to fix or release the screw bolt. A disadvantage with the as-specified mounting aid is that large holes having the size of the assumed adjusting travel have to be present on the hinge part, so that the screw bolt has play required for the adjustment. In addition, it is a disadvantage that a device must be present so that the screw bolt can be fixed on that side of the door arrangement part which is remote from the hinge part. Furthermore, it is a disadvantage that the specified method is costly in terms of materials and is time-consuming, since auxiliary means such as flat material blanks or annular bodies have to be inserted successively until the oversize has been compensated for. With this procedure, the found adjusted position of the hinge can easily be lost again. A further disadvantage is that both the attached annular body and the inserted flat material blanks in each case are pressed only against the shank surface of the screw bolt, so that they may possibly easily come loose by themselves and the set adjusted position is lost without further assistance. Further devices which allow, for example, the inserted flat material blanks or the annular body to be fastened to the shank of the screw bolt make the elaborate and less-effective device even more complicated. A further disadvantage is that only a single reference position for the renewed mounting of the hinge part is specified by the position of the screw bolt. If the hinge part is to be fastened again at the adjusted position, the opening in the hinge part has to be placed over the screw bolt for this purpose. In the process, the screw bolt is at least partly concealed by the door hinge part. A disadvantage in this case is that the door hinge may tilt or cant relative to the screw bolt when bearing against the door arrangement part.

It is the object of the invention to provide a mounting aid according to the preamble of claim 1 and a method according to the preamble of claim 15 or a hinge according to the preamble of claim 19 and a method according to the preamble of claim 31, which, with little outlay, enable a hinge to positioned accurately and in a reproducible manner.

According to the invention, this object is achieved in the case of the aforementioned mounting aid or in the case of the aforementioned hinge by the characterizing features of claim 1 or 19, respectively. Furthermore, according to the invention, this object is achieved in the case of the aforementioned methods by the characterizing features of claim 15 or 31, respectively.

The mounting aid according to the invention provides a clamping screw having an adjusting element, the screw shank of the clamping screw being enclosed with play by the adjusting element. On the door arrangement part, only one tapped hole, which is to be provided in a simple manner, for accommodating the screw shank of the clamping screw is provided in the vicinity of the adjusted position assumed. Large holes in the hinge part or the door arrangement part and the time involved and the material removal associated therewith can be advantageously avoided. Furthermore, it is advantageous that the tapped hole need not pass completely through the door arrangement part. Means for fixing the clamping screw, such as, for example, nuts or a threaded strip, therefore advantageously do not need to be provided on that side of the door arrangement part which is remote from the hinge. This means a material saving and simplified adjustment.

If the hinge has reached its adjusted position on the door arrangement part (or vice versa), the clamping screw of the mounting aid is tightened, so that the screw head of the clamping screw presses the adjusting element against the door arrangement part and thus axially secures said adjusting element. The tightening of the clamping screw is a simple operation which can be carried out quickly and which removes the radial play of the adjusting element and thus secures the found position.

The adjusting element of the mounting aid is brought to bear with a part of the hinge part in a positive-locking manner. Only that part of the adjusting element which bears against the part of the hinge part in a positive-locking manner is to be designed in such a way that it has a shape complementary to the bearing part of the hinge, so that mutual positive-locking engagement occurs. It is advantageous in this case that there is little restriction to the possible design of the shape of the adjusting element. A further advantage obtained is that the adjusting travel available for the adjustment can be set by the selection of an adjusting element having suitable dimensions.

In an advantageous embodiment of the mounting aid according to the invention, provision is made for a mounting plate to be put between the hinge part and the door arrangement part. In this case, that end face of the adjusting element which is remote from the screw head bears against the mounting plate. To accommodate the screw shank of the clamping screw, the mounting plate, in addition to holes for the fastening means, has a further hole through which the shank of the clamping screw engages in a tapped hole provided in the door arrangement part. The mounting plate is advantageously provided with a protective coating, for example a zinc coating, which inhibits the corrosion and increases the service life of the mounting plate and thus of the hinge attached to the door arrangement part. The fitting of the mounting plate is favorable during the production of vehicles in order to cover the paint coating torn after the painting during the removal of the hinge part. It is possible to adhesively bond the mounting plate to the door arrangement part before the hinge part is attached to the mounting plate. If the adjusting element is pressed against the mounting plate by means of the clamping screw, the mounting plate is likewise fixed on the door arrangement part. If a mounting plate is provided for the mounting aid, an advantage of the mounting aid consists in the fact that one process step occurring during the production of motor vehicles can be integrated in a further process step, namely the mounting and the adjustment of the doors on the door frames of the body, so that the work involved during the mounting is reduced.

On account of perforations which are provided in the mounting plate for the attachment of fastening means, such as fastening screws, and are brought into line with apertures of the hinge part, the hinge part and the mounting plate are not held on the door arrangement part by the secured adjusting element alone, so that the adjusting element is relieved in use. The adjusting element, for example, can be removed again and inserted again.

The adjusting element is advantageously designed as a hollow-cylindrical disk, so that the inner radius of the disk ensures maximum play in all directions of the bearing plane. If the adjusting travel proves to be too small for a hollow-cylindrical disk, a disk having the same outer radius but larger inner radius may be provided, this disk offering greater play but still being in positive-locking engagement with the adjacent hinge part. On the other hand, if it turns out that the play of a disk is greater than necessary for the adjustment, a disk having a smaller inner radius may be used. This offers the advantage of setting the optimum adjusting travel for the adjustment by selecting the adjusting element, for example by selecting a hollow-cylindrical disk having an adapted inner radius. For the adjustment of hinges of motor vehicles on the body, it has proved to be advantageous in practice that the inside diameter of the hollow-cylindrical disk is to be at least 1.3 times, preferably 1.5 times, the outside diameter of the screw shank of the clamping screw in order to ensure in each case sufficient play during the mass production of motor vehicles for all the amounts of adjusting travel which occur. A hollow-cylindrical disk as adjusting element has the further advantage that the shape is symmetrical and can be easily overlapped, for example, by the screw head of the clamping screw with a normally likewise circular circumference.

In an advantageous embodiment of the mounting aid according to the invention, an adjusting part arranged outside the adjusting element may be provided in addition to the adjusting element, thereby providing more degrees of freedom for the adjustment.

As a favorable configuration of this embodiment of the mounting aid according to the invention, the adjusting part may be designed as a further clamping screw whose screw shank is enclosed with play by a further adjusting element, for example a further hollow-cylindrical disk. In this embodiment, the play of both adjusting elements advantageously adds up, so that greater adjusting travel is obtained.

In an alternative configuration of this embodiment of the mounting aid according to the invention, the adjusting part may be provided as a projection which is in a fixed position on the bearing plane and is raised in the direction of the hinge. If a mounting plate is provided for the mounting aid, the adjusting part is provided, for example, as an embossment on the mounting plate. If a mounting plate is dispensed with and the hinge is fastened directly to the door arrangement part, the adjusting part is to be provided as a prominence on the door arrangement part. In both cases, the adjusting part can easily be provided on the bearing plane in a cost-effective manner and without complications, and additional parts can be avoided. An adjusting part in a fixed position simplifies the adjustment of the hinge by virtue of the fact that only the adjusting element is established.

The method according to the invention for positioning a hinge in a reproducible manner offers the advantage of establishing a primary and a secondary reference member, that is to say two spaced-apart reference members, on the door arrangement part relative to a predetermined positioning axis, these reference members securing the adjusted position of the hinge part or of the door arrangement part, e.g. the door, in a clearly defined manner.

The hinge according to the invention has at least two fastening parts with at least one respective setback stop margin. The hinge according to the invention permits a simple and lightweight type of construction of the hinge part to be fastened and enables further devices, aimed at providing the fastening parts, to be suitable for the adjustment, the mounting and the stabilizing of the mounted hinge part on the door arrangement part. Furthermore, it is advantageous if the hinge part is designed as a sheet-metal bent part, as a result of which material and costs can be saved during the production of the hinge part.

In an advantageous embodiment of the hinge according to the invention, the fastening parts are angled and have the same direction and the same orientation. Such an embodiment offers the advantage of providing the setback stop margins at the edges remote from the angled portions. The stop margins may in this case be designed in a material-saving manner, e.g. only as concave recesses and not as perforations. Furthermore, it is advantageous that devices for stabilizing the mounted hinge, such as reinforcing beads, can be provided on the angled portions.

In an alternative embodiment of the hinge according to the invention, the fastening parts are angled but point in different, for example opposed, directions. Such a hinge offers the advantage that it is technically simple to embody as a sheet-metal bent part. Furthermore, it is advantageous that means for fastening the hinge part to the door arrangement part can be designed in a conventional manner.

The method according to the invention for mounting a hinge is advantageously characterized by the fact that the hinge is displaced along the bearing plane of the door arrangement part relative to the door arrangement part until it reaches a desired position. In this case, the hinge will be arranged so as to be fixed as a rule, while the door with the reference members is fed in the direction of the stop margins of the hinge part. This in particular avoids a situation in which the hinge part bears perpendicularly on the bearing plane. This has the advantage that the one reference member formed by the adjusting element is not covered by the hinge part itself. Thus the hinge can be already be checked visually to determine whether it has reached the position, and this can be detected automatically. A further advantage obtained is that, during the renewed mounting, the hinge part does not cant or tilt on reference members designed perpendicularly to the bearing plane. Instead, a reference member designed perpendicularly to the bearing plane can stop the displacement of the hinge part relative to the door arrangement part along the bearing plane as soon as a part of the hinge comes to bear with the reference member and in particular limits the displacement of the hinge along the bearing plane relative to the door arrangement part.

In a continuation of the method according to the invention for mounting a hinge, provision is made for at least one of the reference members to be capable of being set in its position. This offers the advantage of being able to find the position of the hinge again during renewed mounting on account of the position of the reference member set during initial mounting.

In a development of the method according to the invention for mounting a hinge, the stop margins of the hinge are, for example, of setback concave design, so that they develop a centering effect when the hinge is mounted on the door arrangement part and make it easier to slip the hinge into position. For the automation of this method, the hinge with its fastening areas is brought to bear on the bearing plane in the vicinity of the associated reference members and moved along the orientation of the setback stop margins toward the reference members, or the reference members are displaced toward the stationary hinge part. The movement ends when the reference members bear in a positive-locking manner against the setback stop margins, for example with the self-centering effect of the setback stop margins being utilized.

Further advantages of the invention follow from the description below of a preferred exemplary embodiment and from the dependent claims.

Figure 1:
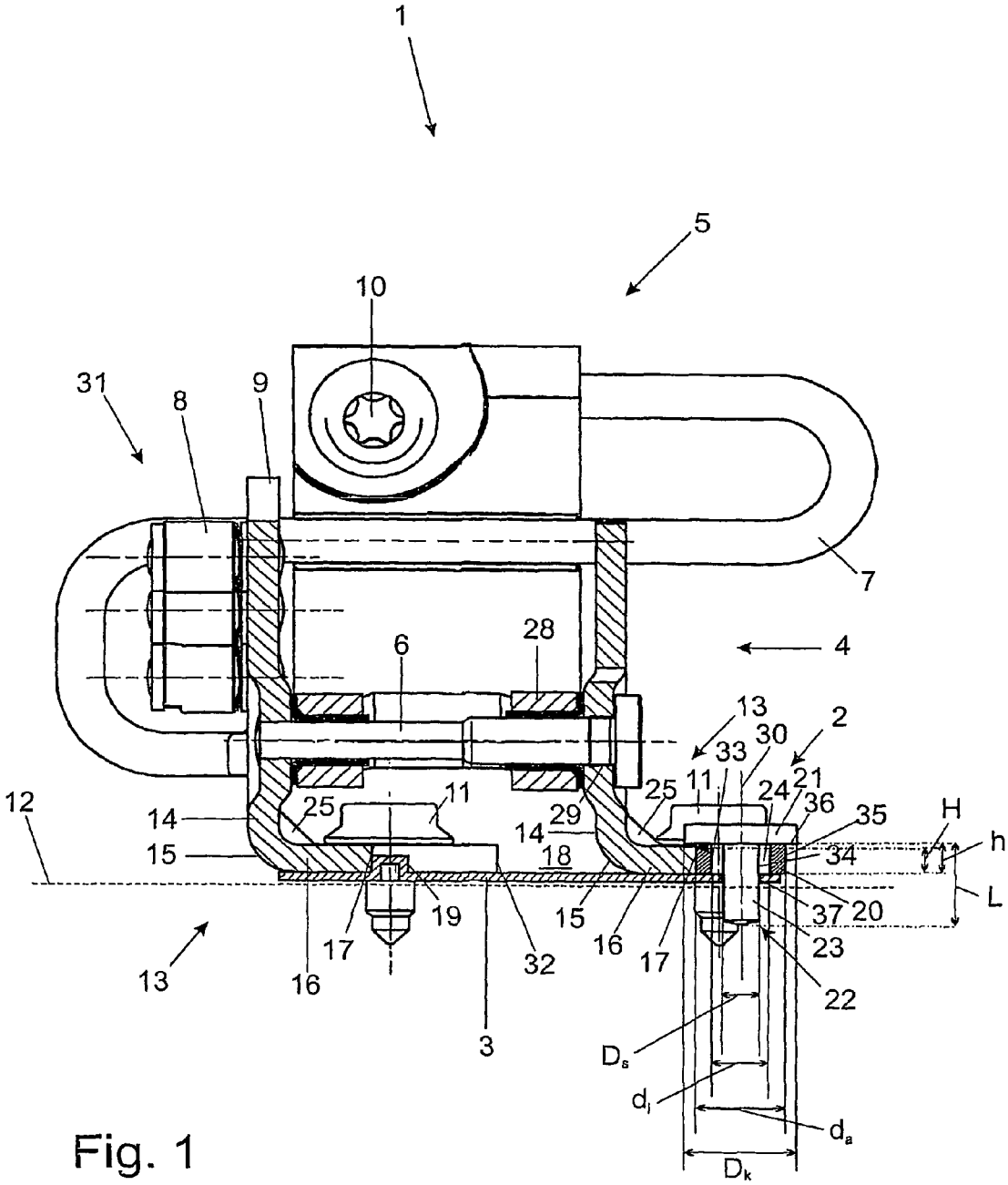
FIG. 1 shows a longitudinal section of a preferred exemplary embodiment of a hinge according to the invention which can be fastened to a door arrangement part by means of a preferred exemplary embodiment of a mounting aid according to the invention.

FIG. 1 shows a hinge 1 which is attached to a body (not shown) of a motor vehicle. A door indicated as broken line 12 is secured to the hinge 1 in an adjusted position with the use of a mounting aid 2.

The hinge 1 having an integrated door arrestor 31 comprises a first hinge part 4, which is shown partly sectioned in the illustration of FIG. 1, a second hinge part 5 and a hinge pin 6. The integrated door arrestor 31 has a torsion bar 7 which is bent in an S shape and a section of which bears against abutment elements 8 which are provided on an abutment plate 9 designed in one piece with the first hinge part 4.

The second hinge part 5 is attached to the vehicle body (not shown) by means of fastening screws 10, whereas the first hinge part 4 is fastened to the door 12 by means of fastening screws 11. The first hinge part 4 has two fastening parts 13, which each consist of a leg 14 accommodating the hinge pin 6, of an angled portion 15 and of a fastening area 16 bent approximately at right angles. The fastening areas 16 are provided with apertures 27, designed as elongated holes, for accommodating the fastening screws 11 and with setback stop margins 17. Both setback stop margins 17 are oriented in the same direction. The shape of the two fastening parts 13 corresponds in longitudinal section in each case approximately to the letter L, both the fastening areas 16 which bear against the bearing plane 18 pointing to the right. In this case, the setback stop margins 17 are designed in such a way that they are open toward the edge 32 remote from the angled portion 15.

Figure 2:
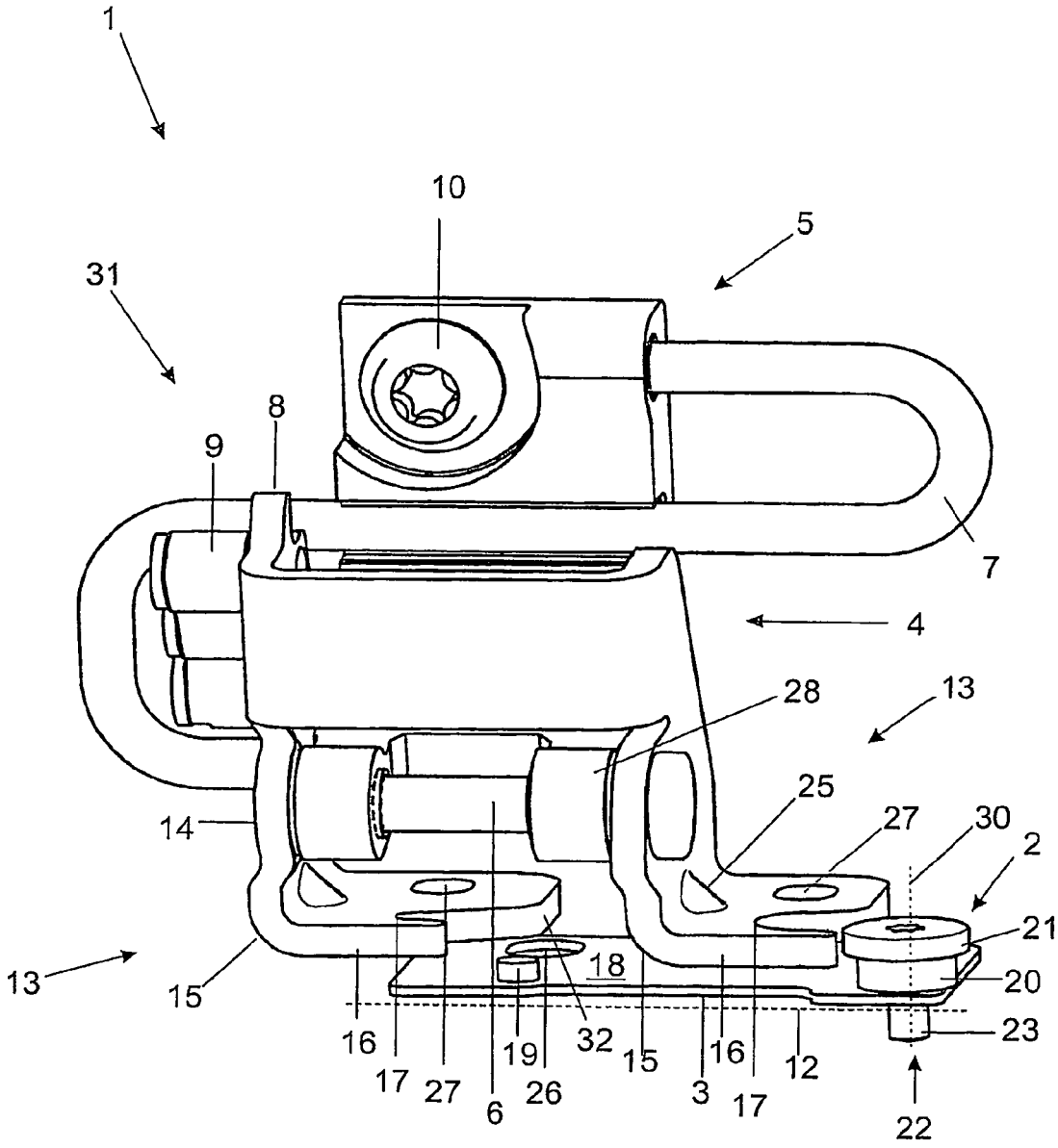
FIG. 2 shows a perspective illustration of the hinge from FIG. 1 in a position separate from the mounting aid.
Figure 3:
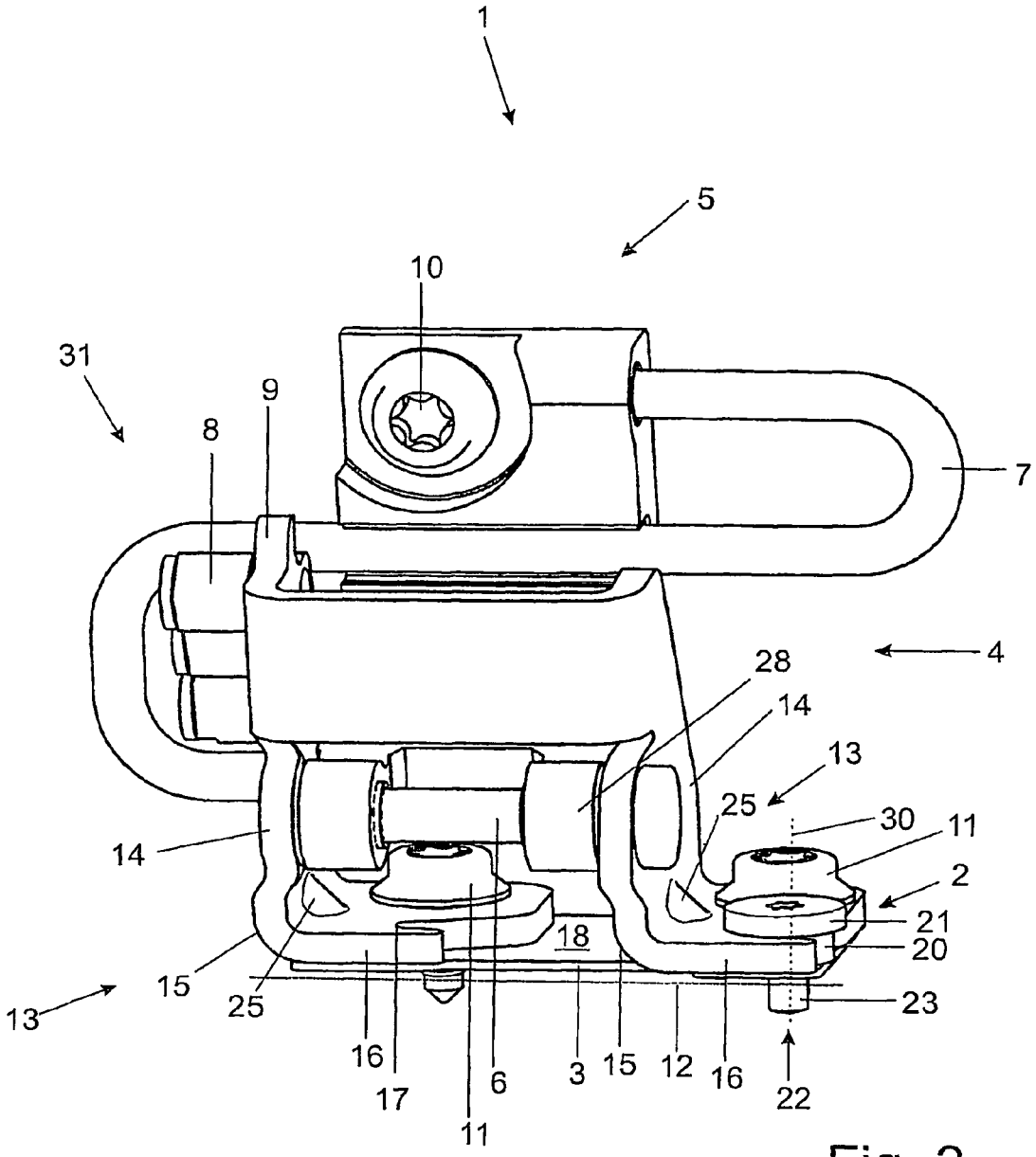
FIG. 3 shows a perspective illustration of the hinge from FIG. 1 in a position bearing against the mounting aid.

The first hinge part 4, to be attached to the door 12, of the hinge 1 must bear the weight of the door 12. In the illustration of FIGS. 1 to 3, the force due to weight points from right to left parallel to the bearing plane 18. The force due to weight thus acts in particular on each of the angled portions 15, there being the risk of the first hinge part 4 bending over or breaking off at the angled portions 15. Stiffening beads 25 are therefore provided at each of the angled portions, these stiffening beads 25 preventing the hinge 1 from bending over at this point. The stiffening beads 25 are provided where the force due to weight acts directly, that is to say, in the hinge 1 shown, along the direction of the setback stop margins 17 in the imaginary connecting line of the center points of the rounded-off portions of the setback stop margins 17 at each of the two angled portions 15.

In the first hinge part 4 of the hinge 1, both fastening areas 16 are oriented in the same direction and to the right, in the direction opposed to the force due to weight. On the other hand, if at least one of the two fastening areas 16 were to point in the other, left-hand direction, the setback stop margin 17 at this one fastening area oriented in the opposite direction would have to be provided as a recess at the angled portion 15 and thus at the location at which, for example, one of the stiffening beads 25 is otherwise provided.

The risk of the failure of the first hinge part 4, attached to the door 12, of the hinge 1 under load is also countered owing to the fact that the hinge pin 6 or a bearing arrangement 28 accommodating the latter is attached parallel to the bearing plane 18. The bearing arrangement 28 of the hinge pin 6 bears in this case against the fastening parts 13 in each case on the legs 14 at apertures 29 and connects both legs 14 firmly to one another. This connection counters simple bending-over of the fastening part 13 of the first hinge part 4 and thus additionally stabilizes the first hinge part 4.

The first hinge part 4 with the abutment plate 9 and the fastening parts 13 having the fastening areas 16 and the apertures 29 for accommodating the bearing arrangement 28 of the hinge pin 6 can be designed in a simple manner as a sheet-metal bent part. Apertures such as the apertures 29 for accommodating the bearing arrangement 28 of the hinge pin 6 or such as the elongated holes of the apertures 27 on the fastening areas 16 and also the setback stop margins 17 at the fastening areas 16 can be produced by means of punching or cutting. The stiffening beads 25 at the angled portions 15 of the fastening parts 13 are also simple to produce. The first hinge part 4 described thus offers a cost-effective alternative to conventional hinge parts.

The mounting aid 2 comprises a mounting plate 3, an adjusting element 20 and a clamping screw 22, the latter comprising a screw head 21 (having a diameter $D_k$) and a screw shank 23 (having a length L and an outside diameter $D_s$). The adjusting element 20 is overlapped by the screw head 21 of the clamping screw 22 and is axially secured against the bearing plane 18, here at the same time the door 12, when clamping screw 22 is tightened.

The adjusting element 20 is designed as a flat hollow cylinder having an outside diameter $d_a$ and an inside diameter $d_i$. The outside diameter $d_a$ of the hollow cylinder is less than or equal to the diameter $D_k$ of the screw head 21 of the clamping screw 22, so that the clamping screw 22 can overlap the adjusting element 20. The inside diameter $d_i$ of the hollow cylinder is greater than the outside diameter $D_s$ of the screw shank 23 of the clamping screw 22, so that a clearance space 24 is produced between the inner surface 33 of the adjusting element 20 and the outer surface 34 of the screw shank 23, this clearance space 24 permitting radial play of the adjusting element 20 on both sides of the screw shank 23 of the clamping screw 22, this radial play having a maximum value $(d_a-d_i)-D_s/2$ with respect to an axis 30 defined by the screw shank 23. The clamping screw 22 in the exemplary embodiment shown has a screw shank 23 having a diameter of 6 mm (M 6) and the hollow-cylindrical disk has an inside diameter $d_i$ of 10 mm. The inside diameter $d_i$ of the hollow-cylindrical disk is therefore more than 1.3 times the outside diameter $D_s$ of the screw shank 23 of the clamping screw 22. During the mounting of doors 12 on hinges 1 in practice, it has been found that the clearance space 24 ensures sufficient play for the adjustment if the ratio $d_i/D_s$ is at least approximately 1.3. It goes without saying that another value of the ratio $d_i/D_s$ may prove to be favorable in other cases.

In a position utilizing the play 24 of the adjusting element 20 to the maximum extent, the inner surface 33 of the hollow-cylindrical disk bears against the outer surface 34 of the screw shank 23 of the clamping screw 22. The outer surface 35 of the hollow-cylindrical disk 20 is then at a distance from the axis 30 of the screw shank 23 of the clamping screw 22 by the maximum amount $D_s/2+(d_a-d_i)$.

The clamping screw 22 completely overlaps the adjusting element 20 in every possible position, that is to say even in this extreme position, so that, for the diameter $D_k$ of the screw head 21, it is the case that its radius $D_k/2$ is greater than or at least equal to the amount $D_s/2+(d_a-d_i)$. Even when the clamping screw 22 is tightened, that region of the first hinge part 4 which bears against the adjusting element 20 is not secured with the adjusting element 20 to the mounting plate 3. To this end, when clamping screw 22 is tightened, the height h of the adjusting element 20, measured from the bearing plane 18 to the bottom edge 36 of the screw head 21, exceeds the maximum thickness H of the fastening area 16, bearing against the adjusting element 20, in the region which is overlapped by the screw head 21 of the clamping screw 22. The screw shank 23 having the length L is screwed into a thread (not shown in FIG. 1 to FIG. 3) provided in the door 12, so that the adjusting element 20 has a reliable hold when the clamping screw 22 is tightened. A reliable hold of the first hinge part 4 to be attached to the door 12 is ensured, for example, if the length L of the screw shank 23 is dimensioned in such a way that the diameter $D_k$ of the screw head 21 of the clamping screw 22 is greater than or equal to two thirds of the length L of the screw shank 23.

The mounting plate 3 designed as a sheet-metal part is put between the door 12 and the first hinge part 4. During the fastening of the hinge 1 with the fastening areas 16, that side of the mounting plate 3 which faces the hinge 1 acts as bearing plane 18. The mounting plate 3 has a hole 37 through which the screw shank 23 of the clamping screw 22 passes. The setback stop margin 17 of the fastening area 16 of fastening part 13 on the left in FIG. 1 to FIG. 3 strikes a projection 19 which is designed as an embossment on the mounting plate 3. The projection 19 has a round cross section, and at the same time the setback stop margin 17 bearing against the projection 19 in a positive-locking manner has a rounded-off profile, so that the first hinge part 4 can be at least partly pivoted about the projection 19, insofar as the fastening screws 11 in the elongated holes of the fastening areas 16 and in the perforations 26 of the mounting plate 3 allow it. The setback stop margin 17 of the fastening area 16 of the fastening part 13 on the right in FIG. 1 to FIG. 3 bears against the adjusting element 20 of the mounting aid 2.

In FIG. 2, the setback stop margin 17 of the right-hand fastening part 13 is not yet in positive-locking engagement with the adjusting element 20 of the mounting aid 2, so that the first hinge part 4 to be fastened to the door 12 can be displaced along the bearing plane 18 by pushing in the direction of the force due to weight.

FIG. 3 shows the hinge 1 and also the mounting aid 2 with the adjusting element 20, the first hinge part 4 while being fastened to the door 12 by attaching one fastening screw 11 each on each of the two fastening areas 16 of the fastening parts 13. To this end, fastening screws 11 pass through the perforations 26 of the mounting plate 3 and at the same time through the elongated holes of the apertures 27 of the fastening areas 16 of the first hinge part 4 to be secured. At the same time, the setback stop margin 17 of the fastening part 13 on the right in FIG. 3 is in positive-locking engagement with the adjusting element 20 of the mounting aid 2. As can be seen in FIG. 1, the setback stop margin 17 of the fastening part 13 on the left in FIG. 3 likewise bears laterally against the projection 19 on the mounting plate 3.

The invention, then, functions as follows:

First of all the mounting plate 3 is placed against the door 12 and the first hinge part 4 to be fastened is placed against the mounting plate 3, the hollow-cylindrical adjusting element 20 is put onto the hole 37 in the mounting plate 3, and the clamping screw 22 is screwed with its screw shank 23 through the hole 37 in the mounting plate 3 into the thread (not shown) provided on the door 12 for this purpose. Accordingly, the adjusting element 20 encloses the screw shank 23 of the clamping screw 22. The clamping screw 22 is not yet tightened, so that the mounting plate 3 is rotatable on the door 12 about the axis 30 and the adjusting element 20 is displaceable on the mounting plate 3 relative to the clamping screw 22. The axis 30 of the clamping screw 22 screwed in place in the door 12 acts as positioning axis.

After that, the mounting plate 3 is pivoted about the shank 23 of the clamping screw 22 until the projection 19 reaches a position which at least comes close to a suspension point of the door on the door frame. In the process, a holding force which can be overcome is already applied to the mounting plate 3 by the clamping screw 22.

The hinge 1 attached to the motor vehicle body (not shown) or alternatively also to a template then has the hinge part 4 in a projecting position in such a way that the mounting plate 3 can be brought to bear against the two fastening areas 16.

The door 12 with the mounting plate 3 is then displaced along the first hinge part 4 until the setback stop margin 17 in each case on the left in FIGS. 1 to 3 bears laterally against the projection 19. At the same time, the adjusting element 20 comes to bear laterally against that setback stop margin 17 of the first hinge part 4 which in each case is on the right in FIGS. 1 to 3. The projection 19 is thus established as primary reference member at a distance from the axis 30. The adjusting element 20 at the same time follows the movement of the first hinge part 4 along the mounting plate 3. By adaptation of the door 12 to the door opening in the vehicle body, the optimum position of the projection 19 is set by rotation about the axis 30 and the optimum position of the adjusting element 20 is set by displacement relative to the axis 30. If the optimum position of the door 12 is reached, the clamping screw 22 is tightened, so that the screw head 23 presses and fixes the adjusting element 20 against the mounting plate 3 and the mounting plate 3 against the door 12. The mounting plate 3 is thus no longer pivotable about the axis 30 and the adjusting element 20 is established as second reference member at a defined distance from the axis 30.

In this position, fastening screws 11 which secure the fastening areas 16 of the first hinge part and the mounting plate 3 to the door 12 can be attached, or alternatively the fitting of the door on the body can be rapidly effected after accurate setting at a template.

The adjusting element 20 can remain axially fixed on the mounting plate 3, for example if the hinge 1 is to be removed again with the door—possibly after releasing the fastening screws 11. Such removal of an accurately set door is a process step during the production of motor vehicles, during which process step the doors are fitted and removed again before the painting in order to be mounted again quickly in the previously fitted, adjusted position after the painting. During the renewed mounting of the door in the position adjusted in this way, the first hinge part 4 with the fastening areas 16 is put onto the mounting plate 3 and moved, the left-hand setback stop margin 17 being brought to bear laterally against the projection 19 and the right-hand setback stop margin 17 being brought to bear laterally against the adjusting element 20, so that the hinge 1 can find the adjusted position again with the aid of the reference members established beforehand. The clamping screw 22 holds the mounting aid 2 fixed in place in the optimum position of the door, so that both the optimum position, found beforehand, of the door 12 can be found again and a visually unfavorable offset of the refitted door relative to the paint coat is reduced.

The adjusting element 20 can be removed once the hinge 1 has finally been fastened to the door 12 by the fastening screws 11. The adjusting element 20 can then be reused for the adjustment of further doors. In the event of the door 12 attached to the vehicle body having to be removed once again, an adjusting element 20 can again be placed beforehand against the right-hand setback stop margin 17 in a positive-locking manner and can be axially secured by means of a clamping screw 22 before the fastening screws 11 are released and the door 12 separated from the hinge 1. The adjusting element 20 and the projection 19 then again form a secondary and a primary reference member which allow the set position on the vehicle body with the hinge 1 to be found when the removed door 12 is mounted again.

In the above exemplary embodiment, the door 12 has been fitted in the direction of the receptive setback stop margin 17 in the direction of the force due to weight. It is to be understood that this operation is likewise possible with a movement against the gravitational force.

The invention claimed is:

1. A mounting aid for positioning a hinge on a door arrangement part, door or door frame, in a reproducible manner, the mounting aid comprising:

a clamping screw having a screw shank and a screw head, an adjusting element which can be placed against a part of the hinge in a positive-locking manner, the adjusting element radially enclosing the screw shank and it being possible for said adjusting element to be axially secured to the door arrangement part by the clamping screw, and a mounting plate which can be put between the hinge and the door arrangement part, wherein the adjusting element has radial play relative to the screw shank, wherein the adjusting element can be placed laterally against the part of the hinge, wherein the screw head overlaps the adjusting element, and wherein the adjusting element, with its complete end face remote from the screw head, bears against a face of the mounting plate facing the screw head.

2. The mounting aid as claimed in claim 1, wherein the mounting plate is designed as a sheet-metal part.

3. The mounting aid as claimed in claim 1, wherein the mounting plate is provided with a protective coating inhibiting the corrosion.

4. The mounting aid as claimed in claim 3, wherein the protective coating inhibiting the corrosion is a zinc coating.

5. The mounting aid as claimed in claim 1, wherein the screw shank passes through a hole in the mounting plate, and wherein the mounting plate is provided with perforations which can be brought into line with apertures of the hinge.

6. The mounting aid as claimed in claim 1, wherein the adjusting element is designed as a hollow-cylindrical disk.

7. The mounting aid as claimed in claim 6, wherein the hollow-cylindrical disk has an inside diameter and an outside diameter, and wherein the inside diameter of the hollow-cylindrical disk is at least 1.3 times an outside diameter of the screw shank of the clamping screw.

8. The mounting aid as claimed in claim 7, wherein the screw head has a diameter, and wherein half the diameter of the screw head is greater than or equal to the sum of half the outside diameter of the screw shank and the difference between the outside diameter and the inside diameter of the hollow-cylindrical disk.

9. The mounting aid as claimed in claim 7, wherein the screw shank has a length, and wherein the diameter of the screw head of the clamping screw at least equals to two thirds of the length of the screw shank of the clamping screw.

10. The mounting aid as claimed in claim 1, wherein the adjusting element has a height, and wherein a fastening area of the hinge has a maximum thickness in a region which is overlapped by the screw head of the clamping screw, and wherein the height of the axially secured adjusting element is dimensioned in such a way that it exceeds the thickness of the fastening area of the hinge.

11. The mounting aid as claimed in claim 1, further comprising at least one further adjusting part, wherein the at least one further adjusting part can be placed against a further part of the hinge in a positive-locking manner.

12. The mounting aid as claimed in claim 11, wherein the further adjusting part is designed as a projection raised relative to a bearing plane of the hinge in a direction of the hinge.

13. The mounting aid as claimed in claim 11, wherein the further adjusting part comprises a further clamping screw and also a further adjusting element which can be placed against the further part of the hinge in a positive-locking manner, the further adjusting element radially enclosing a screw shank of the further clamping screw and it being possible for said further adjusting element to be axially secured to the door arrangement part by the further clamping screw.

14. A mounting aid for positioning a motor vehicle hinge on a door arrangement part, door or door frame, in a reproducible manner, the mounting aid comprising a clamping screw having a screw shank and a screw head, an adjusting element which can be placed against a part of the motor vehicle hinge in a positive-locking manner, the adjusting element radially enclosing the screw shank and it being possible for said adjusting element to be axially secured to the door arrangement part by the clamping screw, and at least one further adjusting part, wherein the adjusting element has radial play relative to the screw shank, wherein the adjusting element can be placed laterally against the part of the motor vehicle hinge, wherein the screw head overlaps the adjusting element, wherein the at least one further adjusting part can be placed against a further part of the motor vehicle hinge in a positive-locking manner, and wherein the adjusting element and the at least one further adjusting part are arranged such that a distance between the adjusting element and the at least one further adjusting part is changeable.

15. The mounting aid as claimed in claim 14, wherein the further adjusting part is designed as a projection raised relative to a bearing plane of the hinge in the direction of the hinge.

16. The mounting aid as claimed in claim 14, wherein the further adjusting part comprises a further clamping screw and also a further adjusting element which can be placed against the further part of the hinge in a positive-locking manner, the further adjusting element radially enclosing the screw shank of the further clamping screw and it being possible for said further adjusting element to be axially secured to the door arrangement part by the further clamping screw.

17. The mounting aid as claimed in claim 14, wherein the adjusting element, with an end face remote from the screw head, bears against a mounting plate, and wherein the mounting plate can be put between the hinge and the door arrangement part.

18. The mounting aid as claimed in claim 17, wherein the mounting plate is designed as a sheet-metal part.

19. The mounting aid as claimed in claim 17, wherein the mounting plate is provided with a protective coating inhibiting the corrosion.

20. The mounting aid as claimed in claim 19, wherein the protective coating inhibiting the corrosion is a zinc coating.

21. The mounting aid as claimed in claim 14, wherein the screw shank passes through a hole in a mounting plate being provided between the hinge and the door arrangement part, and wherein the mounting plate is provided with perforations which can be brought into line with apertures of the hinge.

22. The mounting aid as claimed in claim 14, wherein the adjusting element is designed as a hollow-cylindrical disk.

23. The mounting aid as claimed in claim 22, wherein the hollow-cylindrical disk has an inside diameter and an outside diameter, and wherein the inside diameter of the hollow-cylindrical disk is at least 1.3 times an outside diameter of the screw shank of the clamping screw.

24. The mounting aid as claimed in claim 23, wherein the screw head has a diameter, and wherein half the diameter of the screw head is greater than or equal to the sum of half the outside diameter of the screw shank and the difference between the outside diameter and the inside diameter of the hollow-cylindrical disk.

25. The mounting aid as claimed in claim 23, wherein the screw shank has a length, and wherein the diameter of the screw head of the clamping screw at least equals two thirds of the length of the screw shank of the clamping screw.

26. The mounting aid as claimed in claim 14, wherein the adjusting element has a height, and wherein a fastening area of the hinge has a maximum thickness in a region which is overlapped by the screw head of the clamping screw, and wherein the height of the axially secured adjusting element is dimensioned in such a way that it exceeds the thickness of the fastening area of the hinge.

27. The mounting aid as claimed in claim 1, wherein the hinge comprises:

a first hinge part which is to be fastened to one of the door arrangement parts, door or door frame, a second hinge part which is to be fastened to the other of the door arrangement parts, and a hinge pin which pivotably connects the first hinge part to the second hinge part, with one of the two hinge parts having at least two angled fastening parts which have a respective fastening area for beating against a bearing plane of the door arrangement part, wherein the at least two fastening parts each have a setback stop margin, one of the setback stop margins being the part of the hinge that the adjusting element can be placed against in a positive locking manner, and wherein the setback stop margins are oriented in the same direction.

28. The mounting aid as claimed in claim 27, wherein both the stop margins are designed for engaging in a positive-locking manner together with the adjusting element which is attached to the door arrangement part, the adjusting element being at least partly movable along the door arrangement part and being to be secured to the door arrangement part.

29. The mounting aid as claimed in claim 28, wherein the hinge remains movable, after the adjusting element has been secured, and wherein the hinge remains at least partly rotatable about the secured adjusting element.

30. The mounting aid as claimed in claim 27, wherein the stop margin to which the adjusting element can be placed against in a positive locking manner has a setback rounded-off profile.

31. The mounting aid as claimed in claim 27, wherein the angled fastening parts point in the same direction and have the same orientation.

32. The mounting aid as claimed in claim 27, wherein at least one of the stop margins is provided on an edge remote from the angled portion of the fastening part.

33. The mounting aid as claimed in claim 32, wherein the stop margins are open in the direction of the edge remote from the angled portion of the fastening part.

34. The mounting aid as claimed in claim 27, wherein at least one reinforcing bead is provided on the angled portion of the fastening part.

35. The mounting aid as claimed in claim 27, wherein the stop margins are open in the direction of the edge remote from the angled portion of the fastening part, wherein at least one reinforcing bead is provided on the angled portion of the fastening part, and wherein the reinforcing bead lies in the direction of the stop margins.

36. The mounting aid as claimed in claim 27, wherein the hinge pin is arranged parallel to the bearing plane.

37. The mounting aid as claimed in claim 27, wherein the fastening parts are provided with apertures for accommodating fastening means.

38. The mounting aid as claimed in claim 27, wherein the first hinge part is designed as a sheet-metal bent part.

39. The mounting aid as claimed in claim 14, wherein the distance between the adjusting element and the at least one further adjusting part is changeable due to the radial play of the adjusting element relative to the screw shank.

40. The mounting aid as claimed in claim 39, wherein the adjusting element and the at least one further adjusting part are arranged on a bearing surface and the adjusting element is slidable along the bearing surface to change the distance between the adjusting element and the at least one further adjusting part.

41. A mounting aid for positioning a hinge on a door arrangement part in a reproducible manner, the mounting aid comprising:

a clamping screw having a screw shank and a screw head, and an adjusting element which can be placed against a part of the hinge in a positive-locking manner, the adjusting element radially enclosing the screw shank and it being possible for said adjusting element to be axially secured to the door arrangement part by the clamping screw, wherein the adjusting element has radial play relative to the screw shank, wherein the adjusting element is placeable laterally against the part of hinge, wherein the screw head covers the entire surface of the adjusting element that faces the screw head, such that the adjusting element determines the position of the hinge after the hinge has been removed from the mounting aid while the mounting aid remains in place.

* * * * *